US010590726B1

(12) United States Patent
McAuley et al.

(10) Patent No.: US 10,590,726 B1
(45) Date of Patent: Mar. 17, 2020

(54) SELECT MODE SUBSEA ELECTRONICS MODULE

(71) Applicant: Hydril USA Distribution LLC, Houston, TX (US)

(72) Inventors: Alexander McAuley, Houston, TX (US); Aaron Blinka, Houston, TX (US); Amine Abou-Assaad, Houston, TX (US); David Kindt, Houston, TX (US); James Nolan, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 16/228,065

(22) Filed: Dec. 20, 2018

(51) Int. Cl.

| | |
|---|---|
| ***E21B 33/035*** | (2006.01) |
| ***E21B 33/038*** | (2006.01) |
| ***E21B 33/064*** | (2006.01) |
| *E21B 41/04* | (2006.01) |
| *E21B 33/06* | (2006.01) |

(52) U.S. Cl.
CPC ..... *E21B 33/0355* (2013.01); *E21B 33/038* (2013.01); *E21B 33/064* (2013.01); *E21B 33/063* (2013.01); *E21B 41/04* (2013.01)

(58) Field of Classification Search
CPC ... E21B 33/0355; E21B 33/038; E21B 33/064
See application file for complete search history.

(56) References Cited

U.S. PATENT DOCUMENTS

| | | | | |
|---|---|---|---|---|
| 4,453,566 | A | 6/1984 | Henderson, Jr. | |
| 6,622,799 | B2 * | 9/2003 | Dean | E21B 33/0355 166/339 |
| 8,159,365 | B2 * | 4/2012 | Milne | E21B 33/0355 340/853.1 |
| 9,422,782 | B2 | 8/2016 | McWhorter et al. | |
| 9,828,824 | B2 * | 11/2017 | McAuley | E21B 34/16 |
| 2016/0177700 | A1 * | 6/2016 | Scott | E21B 47/0001 340/850 |
| 2017/0159394 | A1 | 6/2017 | Kalinec | |
| 2018/0238467 | A1 * | 8/2018 | Sundar | G01M 3/02 |

OTHER PUBLICATIONS

Baoping Cai, "Using Bayesian networks in reliability evaluation for subsea blowout preventer control system," 2012, Reliability Engineering and System Safety, vol. 108, pp. 32-41.
"Subsea MUX BOP Control System," Baker Hughes, SeaPrime Subsea MUX BOP Control System Brochure, Apr. 26, 2018, 5 pages.

* cited by examiner

*Primary Examiner* — Matthew R Buck
(74) *Attorney, Agent, or Firm* — Hogan Lovells US LLP

(57) ABSTRACT

A plurality of PODs for a lower marine riser package (LMRP) is disclosed. At least a first subsea electronics module (SEM) and a second SEM are provided in a first POD of the plurality of PODs. At least a third SEM and a fourth SEM are provided in a second pod. The third SEM is redundant with the first SEM and the fourth SEM is redundant with the second SEM. At least one selector circuit is provided to transmit an SEM select signal that electrically activates or electrically deactivates the first SEM separately from the third SEM. As a result, each of the SEMs in the plurality of PODs may be separately activated or deactivated without a need to turn off fluid provided to hydraulic valves in the first and the second PODs that are controlled by corresponding SEMs.

20 Claims, 5 Drawing Sheets

SELECT MODE SUBSEA ELECTRONICS MODULE

BACKGROUND

1. Field of Invention

This disclosure relates in general to oil and gas equipment, and to a subsea electronics module (SEM) for use in oil and gas equipment. In particular, the disclosure provides systems and methods for a select mode to activate or deactivate one of available SEMs in a control pod, separately from its redundant counterpart in another control pod, to enable use of the control POD with components of a lower marine riser package (LMRP) in a blowout preventer (BOP).

2. Related Technology

Blow-out preventer (BOP) systems are hydraulically-controlled systems used to prevent blowouts from subsea oil and gas wells. Subsea BOP equipment typically includes a set of two or more redundant control systems with separate hydraulic pathways to operate a specified BOP function on a BOP lower stack. The redundant control systems are commonly referred to as blue and yellow control PODs. The control PODs are interchangeably referred to herein as PODs. A communications and power cable sends information and electrical power to an actuator with a specific address. The actuator in turn moves a hydraulic valve, thereby opening a fluid path to a series of other valves/piping to control a portion of the BOP. The actuator and hydraulic valve action may be performed by a solenoid valve that receives an electronic input and that reacts by opening or closing the valve associated with a fluid flow. As such, a solenoid and valve or an actuator and valve combination may be referred to as a solenoid valve or a hydraulic valve unless otherwise stated. The opening or closing of the valve as a result of a signal is generally referred to herein as activating or deactivating of the combined valve.

Power and communications connections have been centralized on the control PODs subsea. Each control POD may include one or more subsea electronics modules (SEM(s)) with included electronic modules attached to the SEM for handing power requirements of the solenoids and various other components of a lower marine riser package (LMRP). However, when control has to be switched to a redundant counterpart, such as a different SEM, in a different control pod, the process is time consuming and technically challenging as it may require many deactivations—electrical and/or hydraulic—to complete. Then the different control POD is subject to counterpart processes to activate the connections. Fluid is required to be shut off to or for the deactivated pod, while required to be turned on to the activated pod. Moreover, the SEM of the deactivated POD still actively receives signals meant for the active pod, and continues to activate and deactivate the solenoid or the hydraulic valves in the deactivated pod. As the deactivated POD has no fluid flowing through it, there is no action by the deactivated POD on components requiring fluid control in the BOP. This, however, reduces the life of the solenoid or the hydraulic valves.

SUMMARY

Embodiments of the present disclosure resolve the above identified issues of the SEM and BOP assembly using a novel configuration of the SEM. In an example, a blow-out preventer (BOP) is disclosed as having a BOP lower stack and a lower marine riser package (LMRP). The LMRP includes at least a first subsea electronics module (SEM) and a second SEM in a first pod. The LMRP further includes at least a third SEM and a fourth SEM in a second pod. Particularly, the third SEM is redundant with the first SEM and the fourth SEM is redundant with the second SEM. This redundancy is a safety feature to bring the redundant SEM to active state if the active SEM displays signs of trouble. Further, at least one selector circuit is included for transmitting an SEM select signal that electrically activates or electrically deactivates the first SEM separately from the third SEM. The electrical activation or the electrical deactivation of the first SEM that occurs separately from the third SEM controls fluid for use in BOP components.

In another example, a configuration of multiple PODs for a lower marine riser package (LMRP) is disclosed. The configuration includes at least a first subsea electronics module (SEM) and a second SEM in a first pod, and at least a third SEM and a fourth SEM in a second pod. The third SEM is redundant with the first SEM, while the fourth SEM is redundant with the second SEM. At least one selector circuit transmits an SEM select signal that electrically activates or electrically deactivates the first SEM separately from the third SEM.

In yet another example, a method of operation of PODs for a lower marine riser package (LMRP) is disclosed. The method includes providing at least a first subsea electronics module (SEM) and a second SEM in a first pod, and providing at least a third SEM and a fourth SEM in a second pod. The third SEM is redundant with the first SEM, and the fourth SEM is redundant with the second SEM. A further part of the method includes providing at least one selector circuit with electrical paths to the first SEM, the second SEM, the third SEM, and the fourth SEM. The method includes transmitting an SEM select signal that electrically activates or electrically deactivates the first SEM separately from the third SEM.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION OF THE DISCLOSURE

So that the manner in which the features and advantages of the embodiments for select mode SEMs and PODs, and their associated methods of operation, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
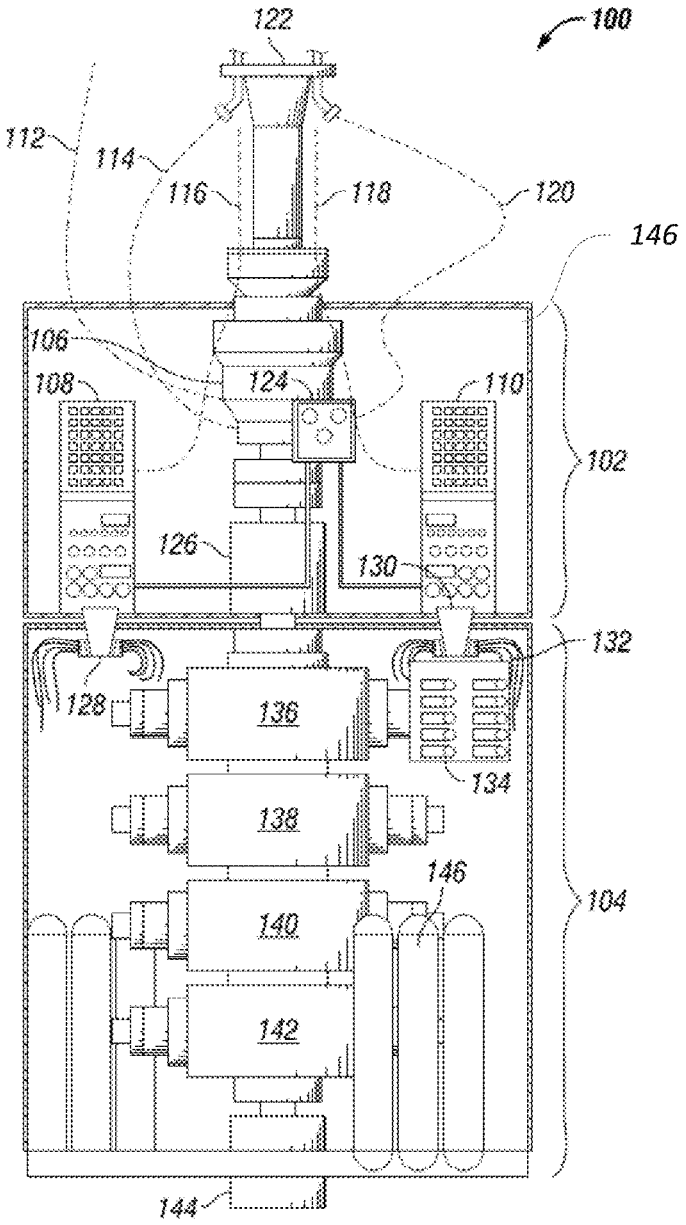
FIG. 1 is a representative system overview of a BOP lower stack and LMRP.

FIG. 1 is a representative system 100 that is an overview of a BOP stack 102, 104 including a BOP lower stack 104 and LMRP 102. A person of ordinary skill would recognize that there may be additional components included in the BOP stack 102, 104, and that the representative system 100 is merely exemplary. LMRP 102 includes an annular 106, a blue control POD 108, and a yellow control POD 110. A hotline 112, a blue conduit 114, and a yellow conduit 120 proceed downwardly from a riser 122 into LMRP 102 and through a conduit manifold 124 to control PODs 108, 110. A blue power and communications line 116 and a yellow power and communications line 118 proceed to control PODs 108, 110, respectively. An LMRP connector 126 connects LMRP 102 to lower stack 104. Hydraulically activated wedges 128 and 130 are disposed to suspend connectable hoses or pipes 132, which can be connected to shuttle panels, such as shuttle panel 134.

Lower stack 104 can include shuttle panel 134, as well as a blind shear ram BOP 136, a casing shear ram BOP 138, a first pipe ram 140, and a second pipe ram 142. BOP lower stack 100 is disposed above a wellhead connection 144. Lower stack 104 can further include optional stack-mounted accumulators 146 containing a necessary amount of hydraulic fluid to operate certain functions within BOP lower stack 100. The blue and yellow control PODs 110, 108 is a subsea component that may include two or more SEMs, a subsea transformer, solenoids, and subsea hydraulic control valves and regulators. Each of the SEMs and the subsea hydraulic control valves and regulators are considered major subsystems of the blue and yellow control PODs 106, 108. The SEMs, apart from providing power, also support collection and transmission of data (e.g., pressure, temperature, flow rate, and ram position) to the surface control subsystem, as well as the electric actuation of subsea hydraulic control valves (also referred to herein as pilot valves) through the solenoids. The two SEMs, within each POD, may be two partly redundant SEM units. Further, each SEM within each of the control PODs (e.g., control POD 110) may be fully redundant with another SEM in a different control POD (e.g., control POD 108). As such, each SEM in POD 110 has a redundant counterpart in POD 108. In addition, subsea hydraulic control valves and regulators can include shuttle valves, lines, SPM valves, and accumulator bottles. The accumulator bottles provide the hydraulic fluid/pressure necessary to actuate a BOP in the event of disconnection from the surface supply. The redundancy, as used herein, in one aspect, is to functions performed or instructions provided by the SEMs to control components within the POD or throughout the BOP.

The blue and yellow PODs may both have active SEMs sending identical signals to solenoids at all times. Only one pod, however, has the hydraulic pressure on its subplate mounted valves (SPMs). As such, one SEM is active by virtue of drying switching, where a lack of underlying fluid implies that no control is offered from the POD hosting such an SEM. However, the inlet or "POD Select Valve" controls which POD is active even though the SEM select signal, from the user input, is sent to both SEMs. As such, a single point failure in possible via the POD Select Valve and as all solenoids/SPM pistons in both PODs are always firing together, there is high wear and tear in both PODs, when only one POD is truly active. Furthermore, straight through functions require special shuttle valves for interflow from both PODs as a result of this configuration.

FIG. 1 also depicts that the LMRP 102 can be releasably connected to the BOP lower stack 104 by a riser connector. Also located at the interface between the LMRP 102 and BOP lower stack 104 are components such as wedges, connectors for choke and kill (C&K) lines, and electric and hydraulic stabs. These components allow disconnection and then subsequent reconnection of components, such as the cables, the C&K lines, and the electric and hydraulic lines for circumstances where the LMRP 102 is released and removed from the BOP lower stack 104 and then reattached. Such a scenario may occur, for example, where a hurricane or other conditions necessitate temporary removal of the LMRP 102 from the BOP lower stack 104 to prevent damage to the system. In addition, the LMRP 102 can include, for example, an Remotely Operated Vehicle (ROV) intervention panel, and a C&K subsystem having a C&K flex loop, C&K valves for the C&K lines, a gas bleed valve, and C&K stab connectors. In addition, the LMRP 102 can include an LMRP connector 126, a riser adapter, a flex joint, LMRP High Pressure High Temperature (HPHT) probes, and a power and communication hub. The LMRP 102 can further include an LMRP subsea control module.

According to some embodiments, the BOP lower stack 104 may include a frame that can have a two-point lifting capability, which allows the frame to be split into two parts. In some embodiments, the entire stack 102, 104 can be retrievable from either a horizontal or vertical position, and the frame can have a wellhead connector position indicator to provide easy viewing of the connector operations.

In some embodiments, the BOP lower stack 104 has a three-piece frame design, including a one-piece LMRP 102 and a two-piece lower stack including upper and lower portions. Various BOPs 136-142 are attachable to individual rather than multiple levels of the frame, allowing the BOP lower stack 104 to be split without removing all the BOPs. Additionally, hydraulic manifolds are provided at each level of the frame; this allows sections of piping to be readily attached to the manifolds when the frame is assembled, simplifying installation and maintenance operations. The three-piece design also facilitates transportation of the BOP lower stack 104 components from the site of manufacture to the drill ship or platform.

In some embodiments, the BOP lower stack 104 is configurable as a 6, 7, or 8 cavity stack. When desired by the user, the configuration can be modified in the field after initial deployment. The BOP lower stack 104 may include modular components which allow double BOPs to be exchanged with single BOPs and vice versa, depending on the needs of the user. Configurability of the stack 102, 104 enables a user to add or subtract BOPs based upon the needs of each wellsite, such as for reasons related to weight, the specific subsea wellhead being used (e.g., 15 ksi or 20 ksi), etc. Because the stack is modular and includes strategically placed connections, in order to replace a damaged or worn BOP, a user can swap a portion of the stack, rather than pulling apart the entire stack, thus reducing down time.

FIG. 1 also illustrates that the LMRP 102 includes a frame 146 around the components 106, 108, 110, 134, 126, and 130. The frame 146 may be designed to include these components of the LMRP 102 in a removable manner. In embodiments, the frame 146 can be a fabricated steel frame painted with a three part epoxy subsea coating. In addition, the frame can include yoke type hangoff beam supports, and one ladder can be included to provide access to the top of the pedestal. In some cases, the pedestal can include padeyes, which can interface with crane lifting blocks. The frame 146 of the LMRP 102 can be designed to support the mounting of acoustic sensors for monitoring the annulars; e.g., annular 106.

A remotely operated vehicle (ROV) may interface with the LMRP systems via an ROV intervention panel is designed to allow the ROV to perform multiple functions on the LMRP 102. A person of ordinary skill would recognize that the present illustration of FIG. 1 includes the ROV intervention panel coupled to the control PODs 108, 110. The functions carried out by an ROV may be as a backup, when the surface controls are not functioning properly. Through the ROV intervention panel, the ROV can carry out some or all of at least the following functions, including LMRP connector primary unlock, LMRP connector secondary unlock, LMRP connector Glycol Flush, all stabs retract, LMRP gasket retract, Inner and outer bleed valves open, Riser connector primary and secondary unlock, Rigid conduit flush isolation valve, Solenoid pilot dump, and LMRP connector POCV by-pass. The ROV intervention panel can be constructed of stainless steel with ROV grab bars, and ROV stabs.

Figure 2:
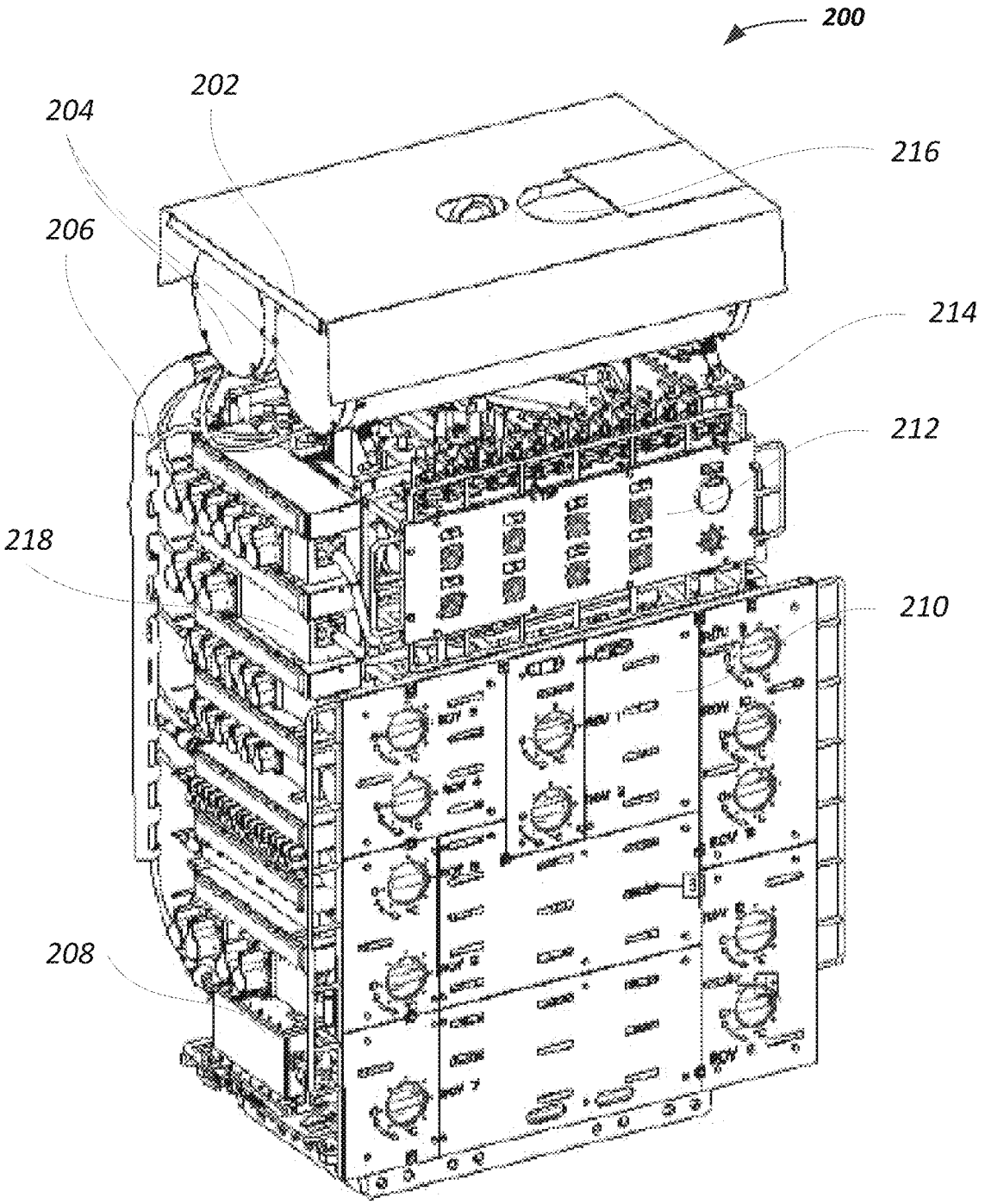
FIG. 2 illustrates an example control POD including SEMs mounted therein.

FIG. 2 illustrates an example control POD 200 including example SEMs 222A, 222B mounted therein. In this example, the SEMs 222A, 222B are constructed as detachable containers that are removable from the control POD 200 via the removal of end cap 202. Example control POD 200 may be a first control POD (often referred to as the yellow control pod) or a second control POD (often referred to as the blue control pod). In the embodiment shown in FIG. 1, the first and second control PODs are illustrated as in the LMRP 102. The first control POD 108 and second control POD 110 can be controlled by controls in located on the vessel. The vessel can be any appropriate vessel, including, for example, a drill ship or a platform.

In operation, the subsea BOP rams of BOPs 136-142 are hydraulically controlled by the first or second POD 108, 110. For example, hydraulic lines 132 run from each of the first and second control PODs 108, 110 to individual rams 136-142 of the BOP lower stack 104. One of the two control PODs 108, 110 may be responsible to hydraulically control the rams through its respective hydraulic lines, while the other control POD remains idle. The idle configuration includes shutting off fluid flow to the control pod, which in turn ensures that there is no fluid exiting the control POD for hydraulic control of components connected to the control pod. This configuration may maintain the signaling to the active and the inactive (redundant) control POD concurrently, but as the inactive (redundant) control POD does not have fluid passing through, any hydraulic or solenoid valve activates or deactivates without any actual effect of control.

When required, the inactive (redundant) control POD may be activated by providing the fluid flow and by stopping fluid flow for the counterpart active control pod, which then deactivates it. As such, redundancy is built into the system because, when the control POD actually controlling components of the BOP, such as the rams, becomes incapacitated for whatever reason, or otherwise requires maintenance or replacement, the inactive (redundant) control POD can be activated to continue operation of the rams. However, it is understood to a person of ordinary skill that the activating and deactivating of the hydraulic or solenoid valve in the inactive (redundant) control POD without fluid flow reduces the life expectancy of the hydraulic or solenoid valve, and/or also subjects the hydraulic or solenoid valves to wear and tear. In addition, maintenance is required for the valves of the inactive POD that are functioning without fluid for control. As such, there is a high likelihood of that a valve may fail for the inactive POD resulting in unprepared rig downtime. Further, swapping the POD is also a time consuming process and could result in unexpected outcomes.

In an embodiment, receivers in the BOP lower stack 104 can be constructed of, for example, galling and corrosion resistant stainless steels. The BOP receivers can be spring-loaded and can be bolted to a welded companion flange on the bottom of the BOP plate. The receiver can also provide function ports for the BOP hydraulic components.

In FIG. 2, the example control POD 200 includes electrical cables 206 from the SEMs 204 to a subplate mounted (SPM) valves or modules 218. The SPM modules 218 may include the SPM and solenoid valve providing the hydraulic control for fluid flow from the control PODs, for instance. These SPM modules may be across multiple banks and of various sizes. The example control POD 200 also includes pressure transducers 208 for monitoring and responding to pressure changes of the various components and systems of the POD and elsewhere in the BOP system. Multiplexer (MUX) cable connection 216 is provided for receiving a multiplex cable for the yellow and blue control PODs. Further components of the control PODs include accumulator charging valves 214, one or more ROV hydraulic stab interface 212, and the ROV intervention or isolation panel 210.

Figure 3:
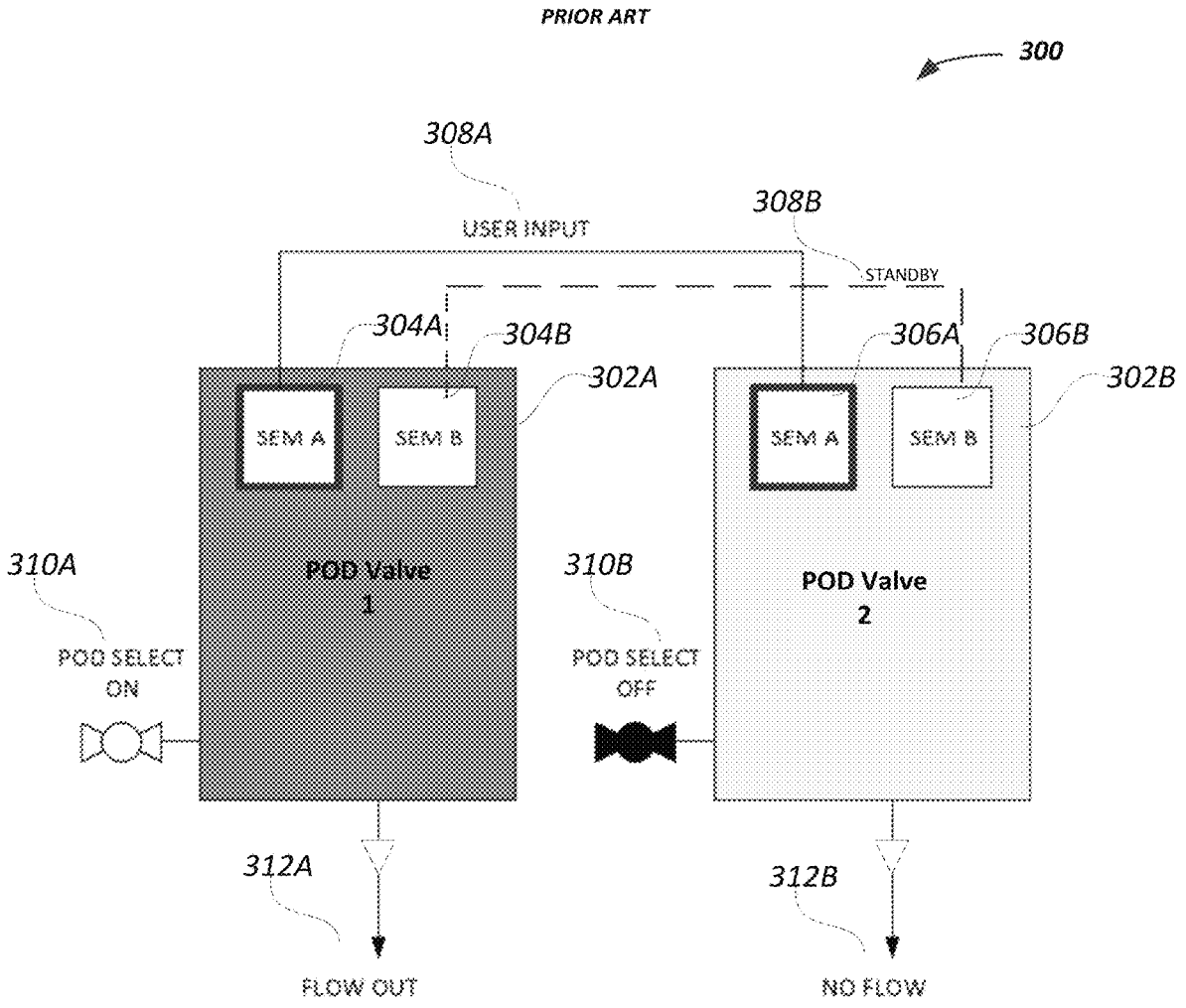
FIG. 3 illustrates an example configuration of PODs with SEMs in a conventional application.

FIG. 3 illustrates control PODs 300 with redundant SEMs in a conventional configuration. Particularly, in FIG. 3, SEM A 304A of POD 302A is an active SEM with SEM A 306A of POD 302B being its redundant counterpart. As SEM A 304A is illustrated as an active SEM, it receives user input 308 for control of the pod's solenoid or hydraulic valves. The solenoid or hydraulic valves in POD 320A are fed via POD SELECT valve 310A is set to ON, which may be an automatic or manual valve for allowing fluid flow into POD 302A so that it may be controllably output via FLOW outlet or port 312A, which is set to OUT. Also illustrated in FIG. 3 is the supply of user input 308 to SEM A 306A which is the redundant counterpart in POD 302B. POD SELECT valve 310B in POD 302B is, however, set to OFF, so that there is no flow into the POD 302B and so that there is no flow out of POD 302B via FLOW outlet or port 312B, which is set to NO FLOW. As such, even though SEM A 306B of POD 302B receives the same user input as SEM A 304A of POD 302A, there is no actual control output from POD 302B. Instead, solenoid or hydraulic valves of POD 302B activate and deactivate without performing any control functions. SEMs B 304B, 306B, are, therefore, in standby mode. The system of FIG. 3, includes hydraulic inlets and outlet connections with retractable wedge ports for controlling flow, in an instance.

In an aspect, the user input may be control input in the form of electrical signals from a surface control subsystem that is manually or automatically operated. The user input activates or deactivates an SEM to provide the signals to its associated solenoid or hydraulic valves in its associated pod. As such, activation or deactivation is used in many ways in this disclosure—at least to indicate which components are turned on and turned off or at least to indicate which components provide an output for an associated input. For example, even though solenoid or hydraulic valves of POD 302B are activated, there is no fluid control from this pod.

As such, POD 302B is inactive, but its solenoid or hydraulic valves are active and its SEM A 306 A is also active by virtue of receiving the user input 308 and providing signals to activate the solenoid or hydraulic valves of POD 302B. SEM B 306B of POD 302B, as in the case of SEM A 306A, provides redundant support for SEM B 304B of POD 302A.

Figure 4:
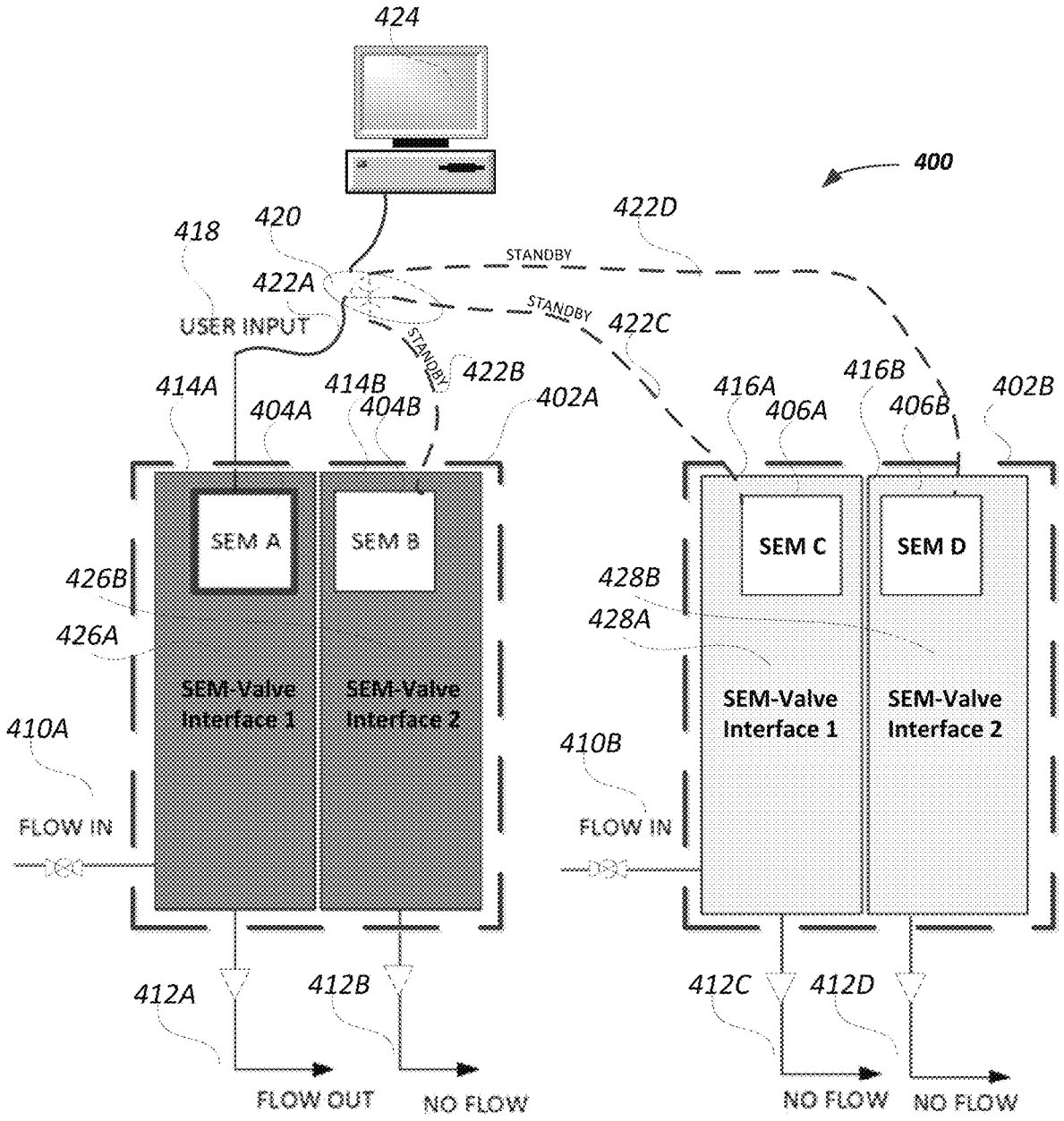
FIG. 4 illustrates an example configuration of PODs with SEMs and using a select mode in a present aspect of the disclosure.

FIG. 4 illustrates an example configuration of PODs with SEMs and using a select mode in a present aspect of the disclosure. Pods 402A and 402B may be similar to PODs 302A and 302B of FIG. 3. Even though illustrated with separation within each POD (i.e., sub-PODs 416A, 416B, 414A, and 414B) which is also referred to as the SEM-valve interfaces), a person of ordinary skill would understand that this separation is merely for illustrative purposes to indicate that SEM A 404A, SEM B 404B, SEM A 406A, and SEM B 406B have their individual associated solenoid or hydraulic valves (referenced in the figure as SEM-Valve Interface 1 and SEM-Valve Interface 2 in each of PODs 402A and 402B. A person of ordinary skill would also recognize that there may be common solenoid or hydraulic valves shared within each pod, but also that some fluid lines may be shared between the two SEMs 404A, 404B and 406A, 406B of respective PODs 402A, 402B. A fluid path for a fluid from an external source is, therefore, provided so that the fluid may traverse through one or more of: (a) first hydraulic valves associated with the first and the second SEMs; and (b) second hydraulic valves associated with the first SEM and third hydraulic valves associated with the second SEM. The first, second, and third hydraulic valves may all be shared with the first, second third, and fourth SEMs, but only the active SEM controls specific valves for the fluid to flow through the fluid path. The standby SEMs do not affect the fluid or the fluid path. However, some functions of an SEM in the same POD are shared with another SEM (as the SEMs in a POD offer at least part redundancy versus SEMs in another POD offering full redundancy to a counterpart SEM in the POD). In such an implementation, the two SEMs in a POD perform their assigned functions to provide the fluid at appropriate function time within designated fluid paths through the shared valves. This may be by timing the signals from the SEM to the valves to stagger the functions so they do not overlap. TABLES 1 and 2 of this disclosure provide examples of such an implementation.

FIG. 4 also illustrates that each POD 402A, 402B includes a FLOW IN valves 410A, 410B, which are in open condition at all times. Valves 410A, 410B may also be referred to as input control valves in each of the first POD and in the second pod. Further, input control valves 410A, 410B are, therefore, always in a hydraulically active state that allows the fluid from an external source to be present within the first POD and within the second pod. A person of ordinary skill would recognize that valves 410A, 410B may be closed in case of certain emergencies or other requirements to enable replacement of the PODs 402A, 402B. As fluid is always available at valves 410A, 410B, the only control applicable to provide or not provide flow at outlets or ports 412A, 412B, 412C, and 412D, is by way of a select mode signal via user input 418. As in the case of FIG. 3, the user input 418 may be from a surface control subsystem, illustrated in FIG. 4 as computer 424. Computer 424 may function as a hardware or software interface to a selector circuit 420. Selector circuit 420 may be a multi-way switch in a hardware configuration or may be a soft switch for directing signal flow. As such, the user input 418 may be signals or lack thereof on each of signal lines or paths 422A, 422B, 422C, and 422D. A soft switch may be a software switch which directs a signal to an appropriate SEM of SEMs 404A, 404B, 406A, and 406B. In an example, this may be performed by a router connected to computer 424. As such, selector circuit 420 may be a router. When selector circuit 420 is a hardware switch, the switch may completely disconnect one of signal lines or paths 422A, 422B, 422C, and 422D from computer 424, so that an SEM select signal does not reach an unintended one of SEMs 404A, 404B, 406A, and 406B. In the example of FIG. 4, SEM A is active and SEMs of SEM-Valve Interface 2 414B, SEM-Valve Interface 1 416A, and SEM-Valve Interface 2 416B are on standby.

In a further aspect, input control valves 410A, 410B in the first POD and in the second POD may be in the hydraulically active state so that fluid, from the external source, is present at all the solenoid or hydraulic values, including—at first hydraulic valves associated with the first SEM, at second hydraulic valves associated with the second SEM, at third hydraulic valves associated with the third SEM, and at fourth hydraulic valves associated with the fourth SEM. Separately, a single shared outlet and a single shared inlet may be provided for the SEMs in each POD. As such, a fluid path is via the activated valves of the activated SEM while the inactive or standby state of an SEM does not allow fluid flow through the shared outlet or inlet valves. This allows for redundant electrical control over singular fluid paths.

In an aspect, computer 424 provides a SEM select signal to activate a SEM of SEMs 404A, 404B, 406A, and 406B. The activated SEM, e.g., SEM A 404A in FIG. 4, may be turned on to, in turn, activate associated solenoid or hydraulic valves, which are simply illustrated as SEM-Valve Interface 1 426A. When activated, fluid in FLOW IN line incorporating valve 410A is able to flow through the activated solenoid or hydraulic valves 426A through FLOW OUT outlet or port 412A and on to various components for controlling those components using the fluid. The outlet or port may also be referred to herein as an output valve. The controlling of components using the fluid may also be to activate those components using the fluid, whereupon the components use a separate fluid for actual functions—e.g., hydraulic ram functions. In an example, the fluid from the FLOW IN line and out of the FLOW OUT outlet or port 412A is, itself, used for performing the actual functions. Further, even though shown as separate FLOW OUT outlets or ports 412A, 412B, and 412C, 412D, each set of the illustrated FLOW OUT outlet or port in each POD 402A or 402B may be a single FLOW OUT outlet or port that outlets fluid associated with SEM-Valve Interface 1 426A or SEM-Valve Interface 2 426B, and separately for SEM-Valve Interface 1 428A or SEM-Valve Interface 2 428B. As such, the outlet, port, or output valve SEM-Valve Interface 1 426A or SEM-Valve Interface 2 426B provides a fluid path for the fluid at input control valves 410A, 410B to exit the first POD for the use in the BOP components. A person of ordinary skill would understand that portions of the fluid maybe output depending on the amount of control or instruction required for the BOP components. As such, not all of the fluid at the input control valves 410A, 410B may make it to the output valve SEM-Valve Interface 1 426A or SEM-Valve Interface 2 426B at the same time.

Flow paths 412A and 412B may also be connected such that activation of SEM A 404A causes fluid to flow to the same BOP component supported by SEM B 404B. As such, activation of SEM A 404A would accomplish the same as activation of SEM B 404B, under one redundancy aspect of the present disclosure. This supports a feature in the present disclosure to operate fluid via flow path 412B by activation of either SEM B or SEM A, independent of each other. The flow path connection within sub-PODs 404A and 404B or 406A and 406B may be inside or outside of the control POD 402A. Similarly, flow path 412A may be connected to flow path 412B, and separately, flow path 412C may be connected with flow path 412D. All these connections may be internal or external to each control POD 402A and 402B. Such a configuration supports individual activation of either one of SEMs A, B, C, and D to accomplish all the required BOP functions through use of a hydraulic shuttle valve arrangement, for instance. As such, the electrically redundant interface of the present configuration using SEMs A, B, C, and D support either an overall single valve for either or both of the inlet and the outlet for and from SEMs A and B, and separately, either a second overall single valve for either or both of the inlet and the outlet for and from SEMs C and D.

As illustrated in FIG. 4, the specific configuration in the figure supports that a counterpart redundant SEM to SEM A 404A, which is SEM A 406A in POD 416A. Unlike the example of FIG. 3, in the configuration of FIG. 4, the user input may not be provided to the counterpart redundant SEM, i.e., SEM A 406A. In this configuration, then, the associated SEM-Valve Interface 1 remains electrically OFF depending on the type of control associated with the valve. Even though there is fluid available in these valves to be provided to outlet or port 412C for controlling components, as SEM-Valve Interface 1 428A is inactive, there is NO FLOW for fluid out of the outlet or port 412C. As such, there is no wear and tear to these valves and switching between SEM A 404A to the counterpart redundant SEM A 406A is faster and safer than in the previous configuration. FIG. 4 also illustrates that other solenoid or hydraulic valves 426B, 428B remain inactive as well in the absence of a SEM select signal. In this manner, only one SEM may be active at any given time without worry of having to turn off or on the inlet valve 410A, 410B.

Figure 5:
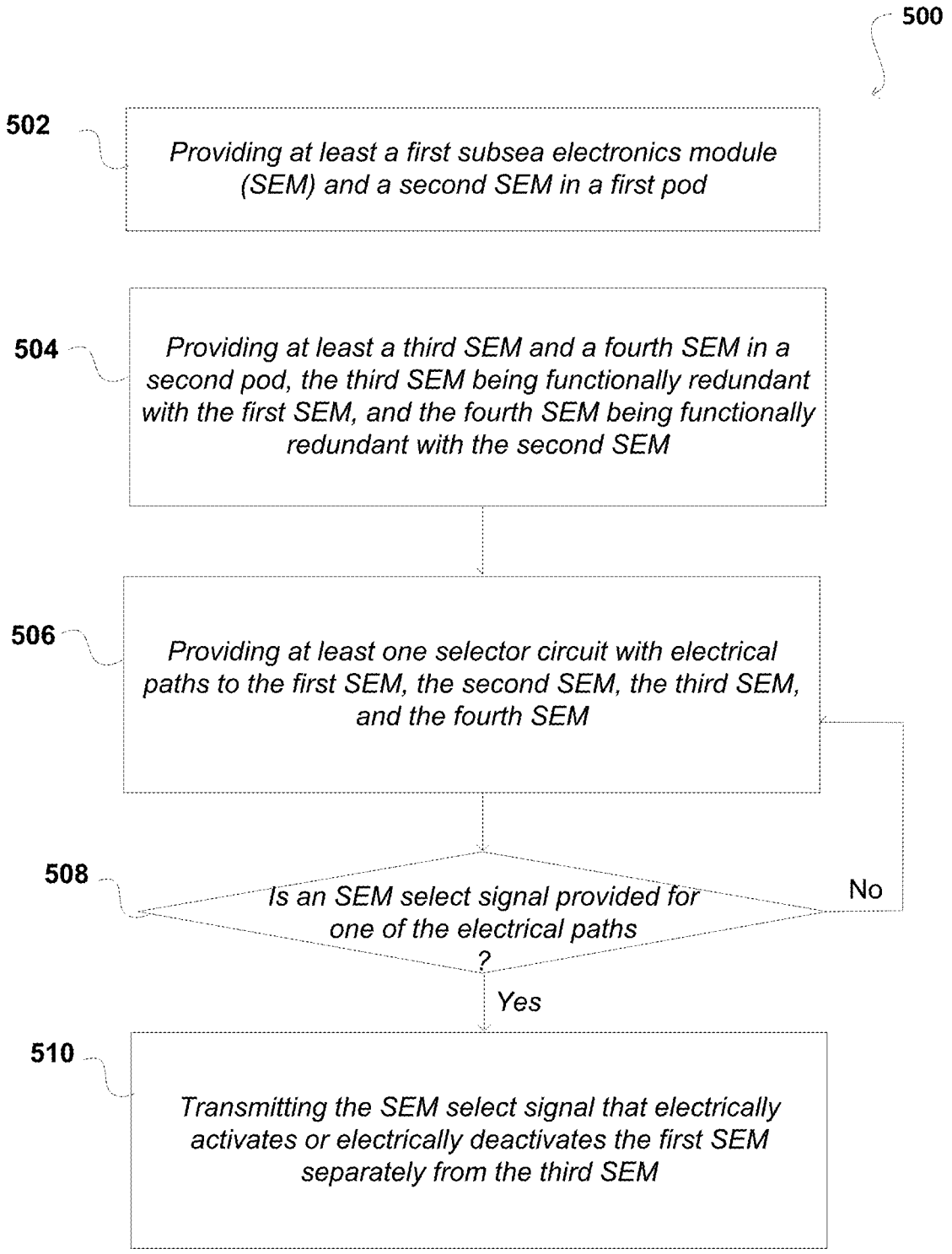
FIG. 5 is a flowchart illustrating an example method of operating PODs for a lower marine riser package (LMRP) in aspects of this disclosure.

FIG. 5 is a flowchart 500 illustrating an example method of interfacing subsea electronics modules (SEMs) with a lower marine riser package (LMRP) in an aspect of the present disclosure. Particularly, the flowchart 500 is an example method of operation of a plurality of PODs including the SEMs for the LMRP. The example method of flowchart 500 may be applicable with the system in FIG. 4, in an aspect of the disclosure. Sub-process 502 provides at least a first subsea electronics module (SEM) and a second SEM in a first pod. Sub-process 504 provides at least a third SEM and a fourth SEM in a second pod. The third SEM is functionally redundant with the first SEM, and the fourth SEM is functionally redundant with the second SEM.

Sub-process 506 provides at least one selector circuit with electrical or signal lines or paths to the first SEM, the second SEM, the third SEM, and the fourth SEM. Further, sub-process 508 determines if an SEM select signal is provided for one of the electrical paths. Alternatively, in another aspect, instead of such a determination, sub-process 508 may determine if an SEM select signal is provided for one of the SEMs. When a determination is that no SEM select signal is received, the select circuit may be monitored continuously. When an SEM select signal is provided so that the determination in sub-process 508 is confirmed—that an SEM select signal is provided for an SEM or for an electrical path, then sub-process 510 transmits the SEM select signal to the specific SEM, such as the first SEM and the SEM select signal electrically activates or electrically deactivates the first SEM separately from the third SEM. This ensures that the SEMs may be activated independently and that they do not continuously remain in an active mode. Indeed, as the inlet valves for fluid is in an always ON state, the present aspect requires the use of the SEM select signal to active an intended SEM without other SEMs changing state, so that fluid flow for control of BOP components come from the POD associated with the solenoids or hydraulic valves of the active SEM.

In a further operative aspect, the method in flowchart 500 further supports providing fluid from an external source to first hydraulic valves and to second hydraulic valves in the first POD and to third hydraulic valves and fourth hydraulic valves in the second pod. Sub-process 510, then supports activating the first SEM by the SEM select signal to open a fluid path through the first hydraulic valves for the fluid to traverse the first POD and to exit the first POD via an output valve. In this implementation the third SEM is maintained in a deactivated status so that the fluid is unable to flow through the third hydraulic valves. In the event of maintenance or other requirements to switch the PODs, the system and method herein supports deactivating the first POD to switch operations to the second pod. This may be by shutting off or switching the selector circuit so that the SEM select signal does not reach the first POD or so that the SEM select signal is now directed to an SEM of the second pod. At the same time, fluid from the external source is maintained to first hydraulic valves and second hydraulic valves in the first POD and to third hydraulic valves and fourth hydraulic valves in the second pod. As such, the second POD may be activated by the provided SEM select signal to activate the redundant SEM—i.e., the above-referenced third SEM in the second pod. The SEM select signal then opens a fluid path through the third hydraulic valves for the fluid to traverse the second POD and to exit the second POD via an output valve. At the same time, the first POD is maintained in a deactivated status so that the fluid is unable to flow out of the second pod, even though it is available in the POD by virtue of the FLOW IN or inlet valve 410A, 410B remaining open, for instance.

An advantage of the present disclosure is that a higher level of redundancy is achieved by the use of the SEM select signal and selector circuit to select individual SEMs, and reduce the burden on the unselected, but fully available redundant SEM. This process takes full reliability advantage of dual coils by removing single point failure of a "POD select valve" which may be by toggling the FLOW IN or inlet valve 410A, 410B. In addition, the advance of the present system and method is also seen in a reduction of power consumption by firing only one solenoid at a time; a reduction of total solenoid valve cycle count by 50%, which supports that the solenoid now lasts twice as long; and a reduction in SPM cycles by 50% as only one SPM in each POD is ever fired, so that each SPM valve seal now lasts twice as long. Further, advantages are also seen in lesser software interlocks from a previously complicated function, as the interface now may only need to fire in 1 SEM all the time or functionally fire in all SEMs all the time (as regulators, for example).

A person of ordinary skill would recognize that the present system increases spares by a function of 1 and increases safety, so that when a function fails, there is no time lost on POD swap. As such, instead of a POD swap of all functions, a single function could be swapped either between SEMs in the currently activated POD or by activating of the function in a redundant POD, along with the redundant POD. Circuits with readbacks can automatically be fired from the associated POD when the first circuit fails and results in each POD always being able to be used for the functions that work inside of it. For example, 80% of function may be fired on SEM A (FIG. 4), while 5% on SEM B may be used concurrently (for instance, due to a power supply failure in SEM A), and 15% of functions on SEMs C and/or D may be used if there are other failures in these SEMs—e.g., due to communication switch failure or excessive leakage in a pilot circuit. As such, duty cycle sharing and optimization to extend maintenance intervals is possible using the present implementation. The SEM select signal may be used to select certain SEMs at certain times and does not necessarily limit selection of one SEM all the time. A plan may be implemented to automatically transfer activation of a function from one SEM to another, periodically, to even out the duty cycle of components, to exercise components that have been idle, or to run tests to determine system health. Not all functions need be treated similarly; for example, regulator control solenoid functions may continue to be activated together. Such an implementation has an additional benefit as the regulators used in the present PODs will not be out of synchronization as the POD select valves have been removed.

In an example, data from the field may be used to build predictive models on usage of components in the POD and/or the BOP, and of expected life under conditions being experienced. This data can be used to secure full redundancy, to its maximum potential, of the present system before maintenance is required. This data can also be utilized to indicate when maintenance will be required. Generation and analysis of a reliability block diagram of the present system may be used to indicate increases in "probability of failure on demand" of components as they wear. When redundant components are switched the failure rate of the system is maintained at the minimum failure rate allowed given the wear on components.

For instance each SEM in FIG. 4 may be fully redundant, but only 25% of each SEM is used to control the BOP. Heat generated is lower and spread over more units in the SEMs which reduces wear and maintains the life of the components. A remaining 75% of each SEM, however, may be seeing no or little wear. As such, the 25% of each SEM that is controlling part of the BOP may be shifted or shared. For example, a BOP with eight components would have only two components commanded from each active SEM. Further, it is often the case that each POD has about 128 functions, which would then be spread out to allow for 32 functions per SEM. As time passes and more wear is accumulated on the 25% of each SEM, this wear becomes large enough to impact failure rates. For example, the 25% activity in each SEM would be (and should be) switched to another active SEM. The present system and method, therefore, supports that the SEMs in each POD may be timed to become active according to a time table established in the form of a duty cycle.

Table 1 provides an example usage of duty cycle switching SEMs so to decrease failure rates and extend maintenance intervals. X indicates function number that is activated by an SEM select signal to the corresponding SEM.

TABLE 1

| Function-> | 1 | 2 | 3 | 4 | 5 | 6 | 7 | 8 |
|---|---|---|---|---|---|---|---|---|
| SEM A | X | X | | | | | | |
| SEM B | | | X | X | | | | |
| SEM C | | | | | X | X | | |
| SEM D | | | | | | | X | X |

Table 2 provides of an example usage of duty cycle taking into consideration changes in function assignment to reduce failure rate.

TABLE 2

| Function-> | 1 | 2 | 3 | 4 | 5 | 6 | 7 | 8 |
|---|---|---|---|---|---|---|---|---|
| SEM A | | | | | X | X | | |
| SEM B | | | | | | | X | X |
| SEM C | X | X | | | | | | |
| SEM D | | | X | X | | | | |

The interface discussed in FIG. 4 may be a redundant SEM interface with dual coils and with dual sensors. Software coding may be provided for the selector circuit (software circuit, hardware circuit, or a hybrid circuit) for SEM command and switch over using the SEM select signal. Control loops on safety functions, including Safety Integrity Levels (SIL rating) may be supported in the present system and method. For example, automatic SEM switching tests may be provided to ensure working systems at predetermined intervals. Further, in an aspect, the FLOW IN or inlet valves 410A, 410B may be removed completely and flow may be provided directly at all times with control at the external source of the fluid, for instance. This aspect then supports low interflow shuttles on straight through functions at the inlet.

As the industry and users of the present method and system most times require certified components and systems, the ability to secure the above-referenced SIL rating provides advantages in the present system. In an example, all functions in the BOP control POD may not need to have automatic switching and duty cycling. Users may request to have a small subset of functions monitored for failures and duty cycle with the added requirement that separate IEC-standards rated hardware monitor the surface and subsea communications. Users may also requests the use of sensors and access to commands for fire (e.g., trigger or select) functions from any SEM or a completely separate POD on surface or subsea when certain criteria are met. The present system may be of a higher fidelity and more practical to implement.

In the various embodiments of the disclosure described, a person having ordinary skill in the art will recognize that alternative arrangements of components, units, conduits, and fibers could be conceived and applied to the present invention.

What is claimed is:

1. A blow-out preventer (BOP) comprising:

a BOP lower stack; and a lower marine riser package (LMRP), wherein the LMRP comprises:

a first subsea electronics module (SEM) and a second SEM in a first pod;

a third SEM and a fourth SEM in a second pod, the third SEM being redundant with the first SEM, and the fourth SEM being redundant with the second SEM;

at least one selector circuit transmitting an SEM select signal that electrically activates the first SEM, while maintaining the third SEM as electrically deactivated, wherein the electrical activation of the first SEM controls fluid for use in BOP components.

2. The BOP of claim 1, further comprising:

input control valves in the first pod and in the second pod, the input control valves for being in a hydraulically active state that allows the fluid from an external source to be present within the first pod and within the second pod.

3. The BOP of claim 1, further comprising:

input control valves in the first pod and in the second pod, the input control valves for being in a hydraulically active state that allows presence of the fluid, from an external source, at first hydraulic valves associated with the first SEM, at second hydraulic valves associated with the second SEM, at third hydraulic valves associated with the third SEM, and at fourth hydraulic valves associated with the fourth SEM.

4. The BOP of claim 1, further comprising:

an output valve providing a fluid path for the fluid to exit the first pod for the use in the BOP components.

5. The BOP of claim 4, further comprising:

the at least one selector circuit maintaining at least one separate portion of electrical paths for the SEM select signal to the second SEM, the third SEM, and the fourth SEM.

6. The BOP of claim 1, further comprising:

a fluid path for the fluid through one or more of: (a) first hydraulic valves associated with the first and the second SEMs; and (b) second hydraulic valves associated with the first SEM and third hydraulic valves associated with the second SEM.

7. The BOP of claim 1, further comprising:

the second SEM being partly redundant with the first SEM, and the fourth SEM being partly redundant with the third SEM.

8. A plurality of pods for a lower marine riser package (LMRP) comprising:

a first subsea electronics module (SEM) and a second SEM in a first pod;

a third SEM and a fourth SEM in a second pod, the third SEM being redundant with the first SEM, and the fourth SEM being redundant with the second SEM; and at least one selector circuit transmitting an SEM select signal that electrically activates the first SEM, while maintaining the third SEM as electrically deactivated.

9. The plurality of pods of claim 8, further comprising:

input control valves in the first pod and in the second pod, the input control valves for being in a hydraulically active state that allows fluid from an external source to be present within the first pod and within the second pod.

10. The plurality of pods of claim 8, further comprising:

input control valves in the first pod and in the second pod, the input control valves for being in a hydraulically active state that allows presence of the fluid, from an external source, at first hydraulic valves associated with the first SEM, at second hydraulic valves associated with the second SEM, at third hydraulic valves associated with the third SEM, and at fourth hydraulic valves associated with the fourth SEM.

11. The plurality of pods of claim 8, further comprising:

a fluid path for a fluid from an external source to traverse the first pod and to exit the first pod for the use with blow-out preventer (BOP) components.

12. The plurality of pods of claim 8, further comprising:

the at least one selector circuit maintaining at least one separate portion of electrical paths for the SEM select signal to the second SEM, the third SEM, and the fourth SEM, wherein the first SEM, the second SEM, the third SEM, and the fourth SEM may each be selected at different times and/or to perform different functions in accordance with a duty cycle.

13. The plurality of pods of claim 8, further comprising:

a fluid path for a fluid from an external source to traverse through one or more of: (a) first hydraulic valves associated with the first and the second SEMs; and (b) second hydraulic valves associated with the first SEM and third hydraulic valves associated with the second SEM.

14. The plurality of pods of claim 8, further comprising:

the second SEM being partly redundant with the first SEM, and the fourth SEM being partly redundant with the third SEM.

15. A method of operation of a plurality of pods for a lower marine riser package (LMRP) comprising:

providing a first subsea electronics module (SEM) and a second SEM in a first pod;

providing a third SEM and a fourth SEM in a second pod, the third SEM being redundant with the first SEM, and the fourth SEM being redundant with the second SEM;

providing at least one selector circuit with electrical paths to the first SEM, the second SEM, the third SEM, and the fourth SEM; and transmitting an SEM select signal that electrically activates the first SEM while maintaining the third SEM as electrically deactivated.

16. The method of claim 15, further comprising:

activating input control valves to allow fluid from an external source to be present within the first pod and within the second pod.

17. The method of claim 15, further comprising:

activating input control valves in the first pod and in the second pod to allow fluid from an external source to be present at: (a) first hydraulic valves associated with the first and the second SEMs and second hydraulic valves associated with the third and the fourth SEMs; or (b) third hydraulic valves associated with the first SEM, fourth hydraulic valves associated with the second SEM, fifth hydraulic valves associated with the third SEM, and sixth hydraulic valves associated with the fourth SEM.

18. The method of claim 15, further comprising:

activating the first SEM by the SEM select signal to open a fluid path for fluid from an external source to traverse the first pod and to exit the first pod via an output valve.

19. The method of claim 18, further comprising:

activating first hydraulic valves by the first SEM, the first hydraulic valves opening the fluid path for the fluid from the external source to traverse the first pod; and maintaining third hydraulic valves associated with the third SEM in a deactivated status so that the fluid is unable to flow through the third hydraulic valves.

20. The method of claim 15, further comprising:

providing fluid from an external source to first hydraulic valves and to second hydraulic valves in the first pod and to third hydraulic valves and fourth hydraulic valves in the second pod;

activating the first SEM by the SEM select signal to open a fluid path through the first hydraulic valves for the fluid to traverse the first pod and to exit the first pod via an output valve; and maintaining the third SEM in a deactivated status so that the fluid is unable to flow through the third hydraulic valves.

* * * * *